US009964897B2

(12) United States Patent
Ishizuka et al.

(10) Patent No.: US 9,964,897 B2
(45) Date of Patent: May 8, 2018

(54) DEVELOPING DEVICE AND IMAGE FORMING APPARATUS

(71) Applicant: Konica Minolta, Inc., Chiyoda-ku, Tokyo (JP)

(72) Inventors: Kazuteru Ishizuka, Saitama (JP); Hiroshi Morimoto, Tokyo (JP); Wataru Watanabe, Tokyo (JP); Tatsuya Furuta, Tokyo (JP); Shota Sakurai, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/618,538

(22) Filed: Jun. 9, 2017

(65) Prior Publication Data

US 2017/0357188 A1 Dec. 14, 2017

(30) Foreign Application Priority Data

Jun. 10, 2016 (JP) ..... 2016-116345

(51) Int. Cl.
*G03G 15/09* (2006.01)
*G03G 15/095* (2006.01)
*G03G 21/16* (2006.01)

(52) U.S. Cl.
CPC ..... *G03G 15/095* (2013.01); *G03G 15/09* (2013.01); *G03G 21/1647* (2013.01)

(58) Field of Classification Search
CPC ..... G03G 15/09; G03G 15/095; G03G 2215/0648
See application file for complete search history.

(56) References Cited

U.S. PATENT DOCUMENTS 6,397,031 B1 * 5/2002 Itoh ..... G03G 15/09 399/269
2013/0315635 A1 * 11/2013 Funada ..... G03G 15/0921 399/269
2014/0023408 A1 * 1/2014 Kato ..... G03G 15/0928 399/269

FOREIGN PATENT DOCUMENTS

JP 2013190632 A 9/2013

* cited by examiner

*Primary Examiner* — Gregory H Curran
(74) *Attorney, Agent, or Firm* — Cantor Colburn LLP

(57) ABSTRACT

A developing device includes a first developing roller, a second developing roller, a first end portion configured to restrict the amount of developer on the second developing roller, a restriction member, and a collecting roller configured to collect developer on the first developing roller. The second end portion is located at a position where magnetic force interference with a magnetic force generated by the second developing roller and the collecting roller is not caused.

16 Claims, 6 Drawing Sheets

DEVELOPING DEVICE AND IMAGE FORMING APPARATUS

CROSS REFERENCE TO RELATED APPLICATIONS

The entire disclosure of Japanese Patent Application No. 2016-116345, filed on Jun. 10, 2016, including description, claims, drawings and abstract are incorporated herein by reference in its entirety.

BACKGROUND OF THE INVENTION

1. Field of the Invention

The present invention relates to a developing device and an image forming apparatus.

2. Description of Related Art

In general, an electrophotographic image forming apparatus (such as a printer, a copy machine, and a fax machine) is configured to irradiate (expose) a charged photoconductor drum (image bearing member) with (to) laser light based on image data to form an electrostatic latent image on the surface of the photoconductor. The electrostatic latent image is then visualized by supplying toner from a developing device to the photoconductor drum on which the electrostatic latent image is formed, whereby a toner image is formed. Further, the toner image is directly or indirectly transferred to a sheet, and then heat and pressure are applied to the sheet at a fixing nip to form a toner image on the sheet.

As such a developing device, a developing device including a plurality of developing rollers for supplying toner to photoconductor drum is known (see, for example, Japanese Patent Application Laid-Open No. 2013-190632).

In the technique disclosed in Japanese Patent Application Laid-Open No. 2013-190632, two developing rollers are disposed on the upper side and the lower side, and developer is passed on from the lower developing roller to the upper developing roller. In addition, the upper developing roller is provided with a collecting roller, and developer remaining on the developing roller without being supplied to the photoconductor drum is collected by the collecting roller.

In the developing roller and the collecting roller, magnets are fixed inside a cylindrical sleeve. The magnets are disposed in the developing roller and the collecting roller such that different poles (hereinafter referred to as "conveyance poles") are alternately arranged in the rotational directions of the developing roller and the collecting roller. The developing roller and the collecting roller absorb developer on the sleeve with the magnetic field generated among the plurality of conveyance poles to convey the developer.

In addition, the magnets inside the collecting roller include magnets of the same pole arranged side by side in the rotational direction (hereinafter referred to as "separation pole"). With the repulsive magnetic field generated at the separation pole, the developer conveyed to the separation pole is separated from the surface of the collecting roller and brought back to the part where the developer is to be housed.

In addition, in general, a restriction member for restricting the conveyance amount of developer on a developing roller is provided, and, in the configuration disclosed in Japanese Patent Application Laid-Open No. 2013-190632, a restriction member is provided only for a lower developing roller.

SUMMARY OF THE INVENTION

Incidentally, in general, a magnetic substance such as metal is used for a restriction member. Lines of magnetic force extend from the conveyance pole and the separation pole of the developing roller and the collecting roller, and consequently the lines of magnetic force and a first end portion opposite to a second end portion for restricting the conveyance amount of the developer are connected to each other, and, magnetic force interference is caused in some situation. When such magnetic force interference is caused, the magnetic pole which has caused the magnetic force interference is changed. Specifically, for example, S pole is changed to N pole when magnetic force interference is caused. When the magnetic poles of the conveyance pole and the separation pole are changed in the developing roller and the collecting roller, the developing roller and the collecting roller cause conveyance failure, separation failure, and the like of developer.

However, in the technique disposed in Japanese Patent Application Laid-Open No. 2013-190632, the space in the developing device is small because of a plurality of developing rollers and collecting rollers, and naturally, the second end portion of the restriction member and the developing rollers and collecting rollers tend to be close to each other. Therefore, the technique disclosed in Japanese Patent Application Laid-Open No. 2013-190632 cannot sufficiently suppress the conveyance failure, separation failure and the like due to magnetic force interference between the restriction member and the developing roller and the collecting roller.

To separate the restriction member from the developing roller and the collecting roller, it is necessary to reduce the length of the restriction member. However, when the length of the restriction member is reduced, the strength of the restriction member is sacrificed. Therefore, the conveyance amount of the developer in the developing roller cannot be restricted, and in turn, the conveyance failure of developing roller can be caused.

An object of the present invention is to provide a developing device and an image forming apparatus which can suppress conveyance failure and separation failure of developer in the developing roller and the collecting roller while maintaining the strength of the restriction member.

To achieve the abovementioned object, a developing device reflecting one aspect of the present invention includes: a developer housing configured to house developer; a first developing roller facing an image bearing member at a first development nip, the first developing roller being configured to convey the developer toward the first development nip; a second developing roller facing the image bearing member at a second development nip on a downstream side relative to the first developing roller in a rotational direction of the image bearing member, and facing the first developing roller, the second developing roller being configured to convey the developer toward the image bearing member; a restriction member including a first end portion and a second end portion located on a side opposite to the first end portion, the first end portion being configured to restrict an amount of the developer on the second developing roller, and the second end portion being configured to generate a magnetic force; and a collecting roller facing the first developing roller in the developer housing, the collecting roller being configured to collect the developer on the first developing roller with a magnetic force at a position on a downstream side relative to the first developing roller in a rotational direction of the first development nip, in which the second end portion is located at a position where magnetic force interference with a magnetic force generated by the second developing roller and the collecting roller is not caused.

Desirably, in the developing device, the collecting roller includes a separation pole configured to generate a magnetic field for separating the developer collected from the first developing roller; the second developing roller includes an absorption pole configured to generate a magnetic field for absorbing the developer in the developer housing; and the second end portion does not intersect a first line or a second line, the first line being an extension of a line passing through a rotation center of the collecting roller and the separation pole, the second line being an extension of a line passing through a rotation center of the second developing roller and the absorption pole.

Desirably, in the developing device, the second end portion is located outside a first circle around a rotation center of the first developing roller, and a second circle around the rotation center of the second developing roller, the first circle being a circle which passes through a fixed part of the restriction member in the developer housing, the second circle being a circle which passes through the fixed part of the restriction member in the developer housing.

Desirably, in the developing device, the second end portion is located on a side opposite to the collecting roller with respect to a third line which is an extension of a line passing through the rotation center of the second developing roller and a restriction pole of the second developing roller, the restriction pole being a pole which faces the first end portion.

Desirably, in the developing device, the collecting roller includes a conveyance pole which is located at a position on a lower side relative to the rotation center of the collecting roller, the conveyance pole being configured to generate a magnetic field for conveying the developer collected from the first developing roller.

Desirably, in the developing device, the restriction member is located on the conveyance pole side relative to the rotation center of the collecting roller.

Desirably, in the developing device, the restriction member is a plate-shaped member fixed in the developer housing; and the second end portion is an end portion of a part bent from a part of the plate-shaped member bent in the developer housing.

Desirably, in the developing device, a rotational direction of the first developing roller is opposite to a rotation direction of the image bearing member at the first development nip; and a rotational direction of the second developing roller is identical to the rotation direction of the image bearing member at the second development nip.

To achieve the abovementioned object, an image forming apparatus includes: a developer housing configured to house developer; a first developing roller facing an image bearing member at a first development nip, the first developing roller being configured to convey the developer toward the first development nip; a second developing roller facing the image bearing member at a second development nip on a downstream side relative to the first developing roller in a rotational direction of the image bearing member, and facing the first developing roller, the second developing roller being configured to convey the developer toward the image bearing member; a restriction member including a first end portion and a second end portion located on a side opposite to the first end portion, the first end portion being configured to restrict an amount of the developer on the second developing roller, and the second end portion being configured to generate a magnetic force; and a collecting roller facing the first developing roller in the developer housing, the collecting roller being configured to collect the developer on the first developing roller with a magnetic force at a position on a downstream side relative to the first developing roller in a rotational direction of the first development nip. The second end portion is located at a position where magnetic force interference with a magnetic force generated by the second developing roller and the collecting roller is not caused.

Desirably, in the image forming apparatus, the collecting roller includes a separation pole configured to generate a magnetic field for separating the developer collected from the first developing roller; the second developing roller includes an absorption pole configured to generate a magnetic field for absorbing the developer in the developer housing; and the second end portion does not intersect a first line or a second line, the first line being an extension of a line passing through a rotation center of the collecting roller and the separation pole, the second line being an extension of a line passing through a rotation center of the second developing roller and the absorption pole.

Desirably, in the image forming apparatus, the second end portion is located outside a first circle around a rotation center of the first developing roller, and a second circle around the rotation center of the second developing roller, the first circle being a circle which passes through a fixed part of the restriction member in the developer housing, the second circle being a circle which passes through the fixed part of the restriction member in the developer housing.

Desirably, in the image forming apparatus, the second end portion is located on a side opposite to the collecting roller with respect to a third line which is an extension of a line passing through the rotation center of the second developing roller and a restriction pole of the second developing roller, the restriction pole being a pole which faces the first end portion.

Desirably, in the image forming apparatus, the collecting roller includes a conveyance pole which is located at a position on a lower side relative to the rotation center of the collecting roller, the conveyance pole being configured to generate a magnetic field for conveying the developer collected from the first developing roller.

Desirably, in the image forming apparatus, the restriction member is located on the conveyance pole side relative to the rotation center of the collecting roller.

Desirably, in the image forming apparatus, the restriction member is a plate-shaped member fixed in the developer housing; and the second end portion is an end portion of a part bent from a part of the plate-shaped member bent in the developer housing.

Desirably, in the image forming apparatus, a rotational direction of the first developing roller is opposite to a rotation direction of the image bearing member at the first development nip; and a rotational direction of the second developing roller is identical to the rotation direction of the image bearing member at the second development nip.

DESCRIPTION OF THE PREFERRED EMBODIMENTS

Figure 1:
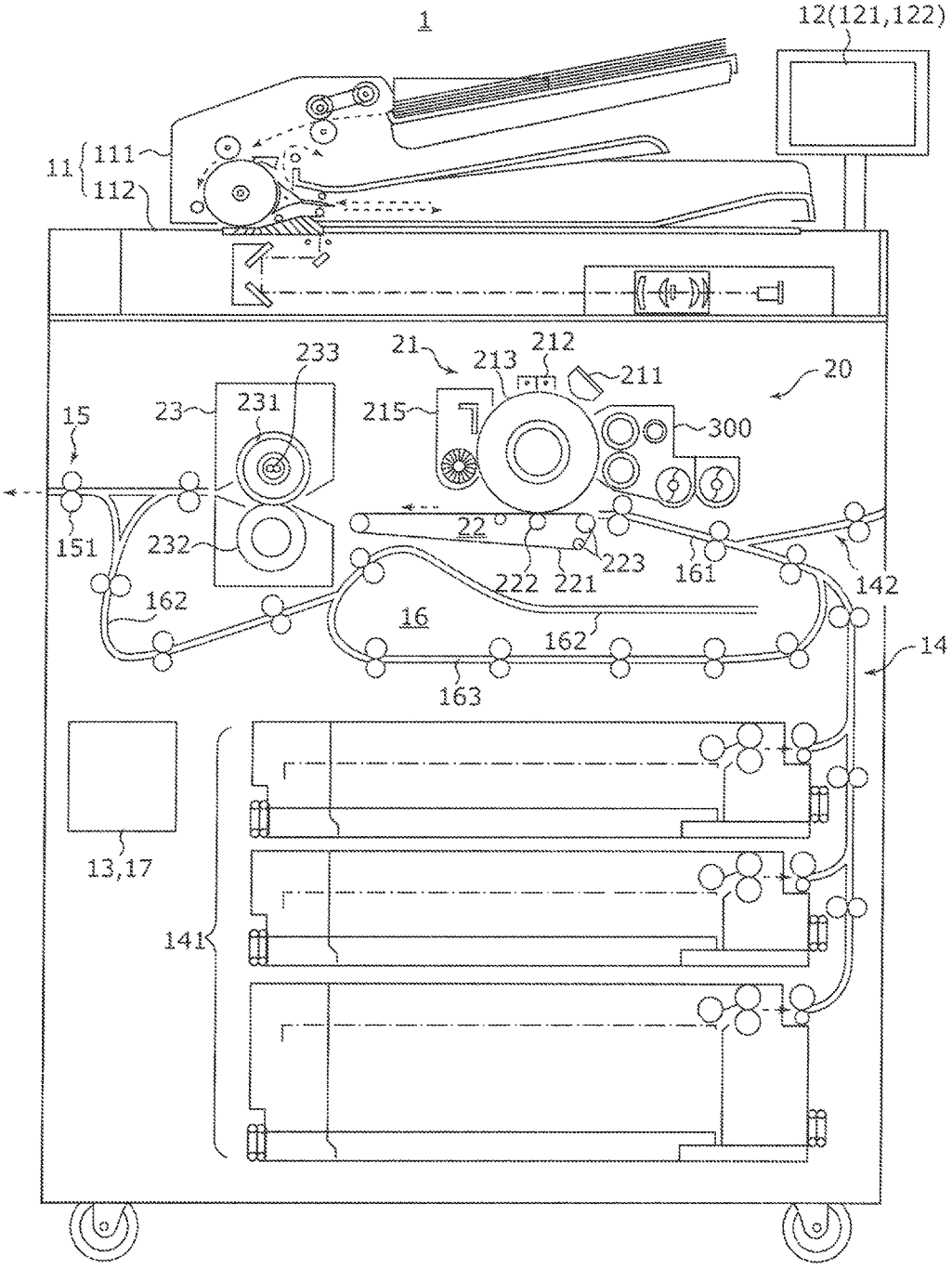
FIG. 1 illustrates a general configuration of an image forming apparatus according to an embodiment.
Figure 2:
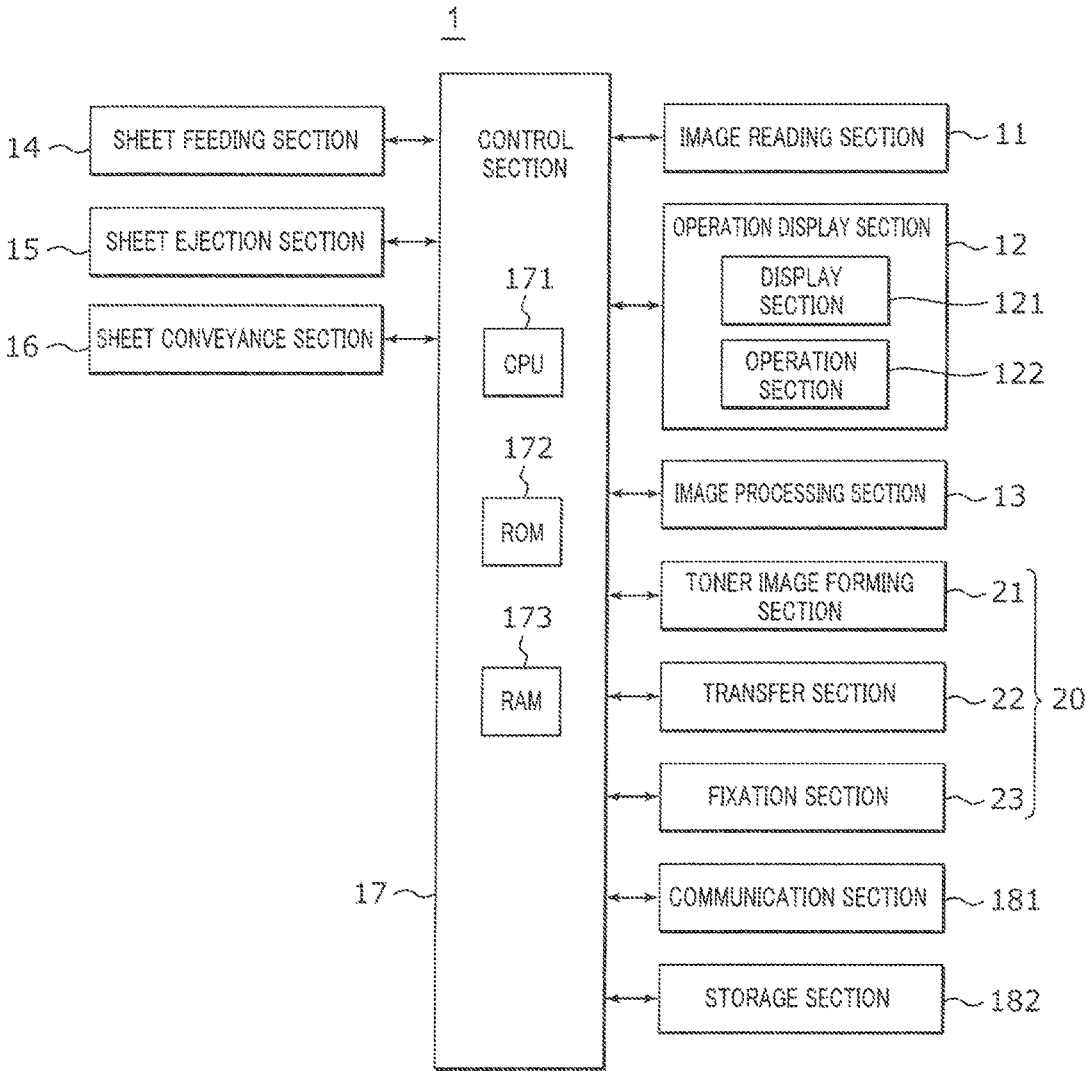
FIG. 2 illustrates a principal part of a control system of the image forming apparatus according to the embodiment.

In the following, an embodiment of the present invention is described in detail with reference to the drawings. FIG. 1 illustrates a general configuration of image forming apparatus 1 according to the embodiment. FIG. 2 illustrates a principal part of a control system of image forming apparatus 1 according to the embodiment.

Image forming apparatus 1 illustrated in FIG. 1 and FIG. 2 is a monochrome image forming apparatus of a direct transfer type which uses electrophotographic process technology. That is, image forming apparatus 1 directly transfers a toner image of a K-component (black) formed on photoconductor drum 213 to a sheet to form an image.

As illustrated in FIG. 1 and FIG. 2, image forming apparatus 1 includes image reading section 11, operation display section 12, image processing section 13, image forming section 20, sheet feeding section 14, sheet ejection section 15, sheet conveyance section 16 and control section 17.

Control section 17 includes central processing unit (CPU) 171, read only memory (ROM) 172, random access memory (RAM) 173 and the like. CPU 171 reads a program suited to processing details out of ROM 172 or storage section 182, develops the program in RAM 173, and integrally controls an operation of each block of image forming apparatus 1 in cooperation with the developed program.

Communication section 181 has various interfaces such as network interface card (NIC), modulator-demodulator (MODEM), and universal serial bus (USB), for example.

Storage section 182 is composed of, for example, a non-volatile semiconductor memory (so-called flash memory) or a hard disk drive. Storage section 182 stores therein a look-up table which is referenced when the operation of each block is controlled, for example.

Control section 17 transmits and receives various data to and from an external apparatus (for example, a personal computer) connected to a communication network such as a local area network (LAN) or a wide area network (WAN), through communication section 181. Control section 17 receives image data (input image data) of page description language (PDL) that has been sent from an external device, and controls the apparatus to form an image on a sheet on the basis of the data, for example.

Image reading section 11 includes an automatic document feeder 111 called auto document feeder (ADF), document image scanner (scanner) 112, and the like.

Auto document feeder 111 causes a conveyance mechanism to feed documents placed on a document tray, and sends out the documents to document image scanner 112. Auto document feeder 111 enables images (even both sides thereof) of a large number of documents placed on the document tray to be successively read at once.

Document image scanner 112 optically scans a document fed from auto document feeder 111 to its contact glass or a document placed on its contact glass, and images light reflected from the document on the light receiving surface of a charge coupled device (CCD) sensor, to thereby read the document image. Image reading section 11 generates input image data on the basis of a reading result provided by document image scanner 112. Image processing section 13 performs predetermined image processing on the input image data.

Operation display section 12 is composed of, for example, a liquid crystal display (LCD) with a touch panel, and functions as display section 121 and operation section 122. Display section 121 displays various operation screens, image conditions, operating statuses of functions, and the like in accordance with display control signals received from control section 17. Operation section 122 includes various operation keys such as numeric keys and a start key, receives various input operations performed by a user, and outputs operation signals to control section 17.

Image processing section 13 includes a circuit that performs a digital image process suited to initial settings or user settings on the input image data, and the like. For example, image processing section 13 performs tone correction on the basis of tone correction data under the control of control section 17. Image processing section 13 also performs various correction processes such as color correction and shading correction on the input image data. Image forming section 20 is controlled on the basis of the image data that has been subjected to these processes.

Image forming section 20 includes: toner image forming section 21 configured to form a toner image of a K-component on the basis of the input image data; transfer section 22 configured to transfer a toner image formed by toner image forming sections 21 to a sheet; fixation section 23 configured to fix a transferred toner image to a sheet; and the like.

Toner image forming section 21 includes exposing device 211, charging device 212, photoconductor drum 213, developing device 300, drum cleaning device 215 and the like.

Photoconductor drum 213 is a negative-charging type organic photoconductor (OPC) in which an undercoat layer (UCL), a charge generation layer (CGL), and charge transport layer (CTL) are sequentially stacked on a peripheral surface of a conductive cylindrical body made of aluminum (aluminum raw pipe), for example.

Charging device 212 is composed of a corona discharging generator such as a scorotron charging device and a corotron charging device, for example. Charging device 212 evenly negatively charges the surface of photoconductor drum 213 by corona discharge.

Exposing device 211 irradiates photoconductor drum 213 with light corresponding to a monochrome image. The positive charge generated in the charge generation layer of photoconductor drum 213 irradiated with light is transported to the surface of the charge transport layer, whereby the surface charge (negative charge) of photoconductor drum 213 is neutralized. Thus, an electrostatic latent image is formed on the surface of photoconductor drum 213 by the potential difference from its surroundings.

Developing device 300 stores developer of a K-component (for example, a two-component developer composed of toner and magnetic carrier). Developing device 300 attaches toner of a K-component to the surface of photoconductor drum 213, and visualizes the electrostatic latent image to form a toner image. Developing device 300 will be described in detail later.

Drum cleaning device 215 includes a drum cleaning blade which is brought into sliding contact with the surface of photoconductor drum 213 and the like, and removes the transfer residual toner remaining on the surface of photoconductor drum 213 after the transfer.

Transfer section 22 includes transfer belt 221, transfer roller 222, a plurality of support rollers 223 and the like.

Transfer belt 221 is composed of an endless belt, and is disposed around support rollers 223 in a loop form. At least one of support rollers 223 is composed of a driving roller, and the others are each composed of a driven roller. When the driving roller rotates, transfer belt 221 travels and a sheets is conveyed at a constant speed.

Transfer roller 222 is disposed on the internal periphery side of transfer belt 221 in such a manner as to face photoconductor drum 213. Transfer roller 222 is brought into pressure contact with photoconductor drum 213 with transfer belt 221 therebetween, whereby a transfer nip for transferring a toner image from photoconductor drum 213 to a sheet is formed.

When a sheet passes through the transfer nip, the toner image on photoconductor drum 213 is transferred to the sheet. To be more specific, a transfer bias is applied to transfer roller 222, and an electric charge (positive charge) having a polarity opposite to that of the toner is applied to the rear side of the sheet, that is, the side on which the sheet makes contact with transfer belt 221, whereby the toner image is electrostatically transferred to the sheet. The sheet on which the toner image has been transferred is conveyed toward fixation section 23.

Fixation section 23 includes: upper fixation section 231 having a fixing side member disposed on a fixing surface side of a sheet, that is, the side on which a toner image is formed; lower fixation section 232 having a back side supporting member disposed on the rear surface side of the sheet, that is, the side opposite to the fixing surface; heating source 233 configured to heat the fixing side member, and the like.

Heat and pressure are applied to a sheet on which a toner image has been transferred and which has been conveyed along a sheet feeding path at the time when the sheet passes through fixation section 23. Thus, the toner image is fixed to the sheet.

Sheet feeding section 14 includes sheet feed tray section 141 and manual sheet feeding section 142. Flat sheets (standard type sheets and special type sheets) discriminated on the basis of their basis weight, size and the like are stored in sheet feed tray section 141 in advance on a predetermined type basis. Sheet feeding section 14 feeds a sheet fed from sheet tray section 141 or manual sheet feeding section 142 to sheet conveyance section 16.

Sheet ejection section 15 includes sheet ejection roller section 151 and the like, and ejects a sheet output by sheet conveyance section 16 out of the apparatus. Sheet conveyance section 16 includes main conveyance section 161, switch-back conveyance section 162, rear surface printing conveyance section 163 and the like.

A sheet fed from sheet feeding section 14 is conveyed to image forming section 20 by main conveyance section 161. Thereafter, a toner image on photoconductor drum 213 is transferred to a first surface (front surface) of the sheet at one time at the time when the sheet passes through the transfer nip, and then a fixing process is performed in fixation section 23. A sheet on which an image is formed is ejected out of the apparatus by sheet ejection section 15. When images are formed on both sides of a sheet, the sheet on which an image has been formed on its first surface is output to switch-back conveyance section 162, and then inverted by being returned to main conveyance section 161 through rear surface printing conveyance section 163 before an image is formed on its second surface (rear surface).

Figure 3:
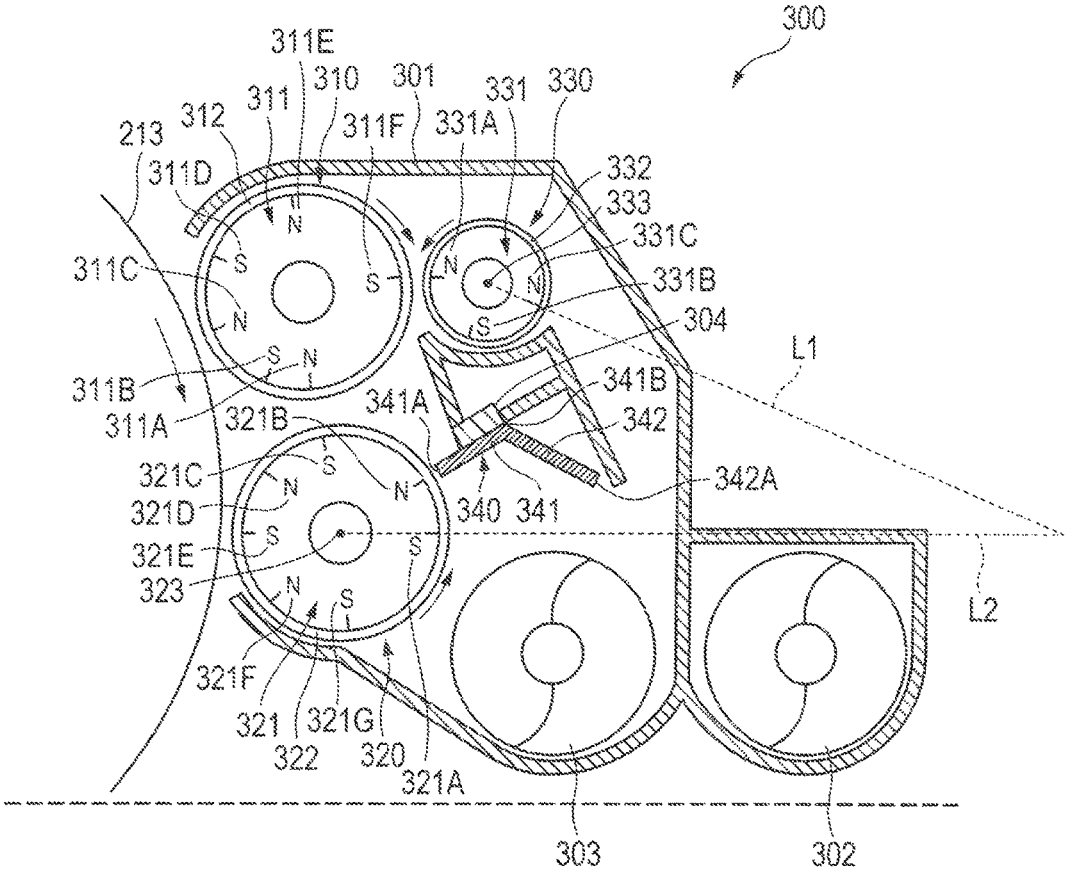
FIG. 3 is a sectional view illustrating a developing device.

Next, details of the structure of developing device 300 are described. FIG. 3 is a sectional view illustrating developing device 300. As illustrated in FIG. 3, developing device 300 is composed of developer housing 301 that houses developer including toner and carrier. First agitation member 302, second agitation member 303, first developing roller 310, second developing roller 320, collecting roller 330, and restriction member 340 are provided in developer housing 301.

First agitation member 302 and second agitation member 303 rotate to convey developer in the axial direction, and agitate the developer in developer housing 301.

First developing roller 310 faces photoconductor drum 213, and rotates in a direction opposite to that of photoconductor drum 213, that is, in the clockwise direction in the drawing at a first development nip where first developing roller 310 faces photoconductor drum 213. First developing roller 310 absorbs developer with a magnetic force, and conveys the absorbed developer toward the first development nip. The developer conveyed by first developing roller 310 is supplied to photoconductor drum 213 at the first development nip. First developing roller 310 includes non-rotatable first fixation magnet 311, and rotatable cylindrical first sleeve 312.

First fixation magnet 311 is disposed inside first sleeve 312, and includes magnetic poles 311A, 311B, 311C, 311D, 311E, and 311F. Magnetic poles 311A, 311B, 311C, 311D, 311E, and 311F are N pole, S pole, N pole, S pole, N pole, and S pole, respectively, and arranged in this order in the rotational direction of first developing roller 310 (hereinafter referred to as "first rotational direction"). With the magnetic field which is generated by S pole and N pole alternately disposed at parts of magnetic poles 311A, 311B, 311C, 311D, 311E, and 311F, first developing roller 310 conveys the developer which is absorbed on first sleeve 312 in the first rotational direction.

That is, magnetic poles 311A, 311B, 311C, 311D, 311E, and 311F serve as conveyance poles that generate a magnetic field for conveying developer in the first rotational direction with the magnetic force. In addition, magnetic pole 311A is located at a position to face second developing roller 320, and serves as a pole for receiving developer from second developing roller 320 with the magnetic force in a relationship with magnetic pole 321C described later.

In addition, magnetic pole 311F faces collecting roller 330 at a position on the downstream side relative to the first development nip (the part of magnetic pole 311C in FIG. 3) in the first rotational direction, and serves as a pole that generates a magnetic field for collection of developer by collecting roller 330 with the magnetic force in a relationship with magnetic pole 331A described later.

Second developing roller 320 faces photoconductor drum 213 at a position on the downstream side relative to the first development nip in the rotational direction of photoconductor drum 213, and rotates in a direction identical to that of photoconductor drum 213 at a second development nip where second developing roller 320 faces photoconductor drum 213, that is, in the counterclockwise direction in the drawing. Second developing roller 320 absorbs the developer in developer housing 301 with the magnetic force, and conveys the absorbed developer toward the second development nip. The developer conveyed by second developing roller 320 is supplied to photoconductor drum 213 at the second development nip. Second developing roller 320 includes non-rotatable second fixation magnet 321, and rotatable cylindrical second sleeve 322.

Second fixation magnet 321 is disposed inside second sleeve 322, and includes magnetic poles 321A, 321B, 321C, 321D, 321E, 321F, and 321G. Magnetic poles 321A, 321B, 321C, 321D, 321E, 321F, and 321G are S pole, N pole, S pole, N pole, S pole, N pole, and S pole, respectively, and are arranged in this order in the rotational direction of second developing roller 320 (hereinafter referred to as "second rotational direction"). With the magnetic field which is generated by S pole and N pole alternately disposed at parts of magnetic poles 321A, 321B, 321C, 321D, 321E, 321F, and 321G, second developing roller 320 conveys the developer which is absorbed on second sleeve 322 in the second rotational direction.

That is, magnetic poles 321A, 321B, 321C, 321D, 321E, 321F, and 321G serve as conveyance poles that generate a magnetic field for conveying developer which is absorbed by second sleeve 322 in the second rotational direction with the magnetic force.

In addition, magnetic pole 321A is located at a position where second developing roller 320 faces the developer in developer housing 301, and serves as an absorption pole that generates a magnetic field for absorbing the developer in developer housing 301 to the surface of first sleeve 312.

In addition, magnetic pole 321B faces restriction member 340, and serves as a restriction pole for restricting the conveyance amount of the absorbed developer.

In addition, magnetic pole 321C is located at a position to face first developing roller 310, and serves as a pole for passing on developer to first developing roller 310 in a relationship with magnetic pole 311A of first developing roller 310. That is, a magnetic field that moves developer from second developing roller 320 to first developing roller 310 is generated between magnetic pole 321C that is S pole and magnetic pole 311A that is N pole, and thus a part of the developer absorbed on second developing roller 320 is passed on to first developing roller 310.

In addition, magnetic pole 321G is located at a position on the downstream side relative to the second development nip (the part of magnetic pole 321E in FIG. 3) in the second rotational direction. Magnetic pole 321G serves as a pole for bringing back into developer housing 301 the remaining developer which has not been supplied to photoconductor drum 213 with a repulsive magnetic field generated with magnetic pole 321A of the same pole.

Collecting roller 330 is disposed to face first developing roller 310. Collecting roller 330 rotates in a direction identical to that of first developing roller 310, that is, in the counterclockwise direction in the drawing at a position where collecting roller 330 faces first developing roller 310. Collecting roller 330 includes non-rotatable collection fixation magnet 331, and rotatable cylindrical collection sleeve 332.

Collection fixation magnet 331 is disposed inside collection sleeve 332, and includes magnetic poles 331A, 331B, and 331C. Magnetic poles 331A, 331B, and 331C are N pole, S pole, and N pole, respectively, and arranged in this order in the rotational direction of collecting roller 330 (hereinafter referred to as "third rotational direction"). With the magnetic field generated by N pole and S pole alternately disposed at parts of magnetic poles 331A, 331B, and 331C, collecting roller 330 conveys developer absorbed on collection sleeve 332 in the third rotational direction.

That is, magnetic poles 331A, 331B, and 331C serve as conveyance poles that generate a magnetic field for conveying the developer absorbed on collection sleeve 332 in the third rotational direction with the magnetic force. In addition, magnetic pole 331A is located at a position to face first developing roller 310 in collecting roller 330, and, in a relationship with magnetic pole 311F of first developing roller 310, serves as a pole for collecting developer which remains on first developing roller 310 without being supplied to photoconductor drum 213 by first developing roller 310. That is, collecting roller 330 collects developer on first developing roller 310 with the magnetic force at a position on the downstream side relative to the first development nip in the first rotational direction.

Incidentally, in the configuration disclosed in Japanese Patent Application Laid-Open No. 2013-190632, collecting roller 330 rotates in the direction opposite to that of third rotational direction. In this configuration, the developer collected from first developing roller 310 is conveyed such that the developer is lifted by collecting roller 330. Therefore, at the time of conveyance, the developer can fall from collecting roller 330 and can be again supplied to first developing roller 310 at a part where collecting roller 330 and first developing roller 310 face each other in some situation, for example.

In the present embodiment, magnetic pole 331B is located at a position on the lower side relative to rotation center 331 of collecting roller 330. That is, collecting roller 330 conveys the developer collected by magnetic pole 331A toward the lower side, and thus, when the developer falls off from collecting roller 330, the developer does not return to the part where collecting roller 330 and first developing roller 310 face each other. In this manner, the collection efficiency of collecting roller 330 can be improved.

Magnetic pole 331C and magnetic pole 331A of the same pole are arranged side by side in the third rotational direction, and thus magnetic pole 331C generates a repulsive magnetic field with magnetic pole 331A. That is, magnetic pole 331C serves as a separation pole that generates a magnetic field for separating, from collection sleeve 332 of collecting roller 330, developer conveyed to a part of magnetic pole 331C by magnetic pole 331B with a magnetic force, that is, a repulsive magnetic field. The developer separated from collection sleeve 332 is brought back to developer housing 301.

Restriction member 340 is a plate-shaped member composed of a magnetic substance such as metal or the like, and restricts the conveyance amount of developer on second developing roller 320. Restriction member 340 is located at a position on the lower side of collecting roller 330, that is, on magnetic pole 331B, which is the conveyance pole, side relative to rotation center 333 of collecting roller 330. Restriction member 340 includes first portion 341 and second portion 342.

First portion 341 is fixed at fixing part 304 disposed at an appropriate position in developer housing 301 such that first portion 341 extends from the part fixed with fixing part 304 toward first developing roller 310. First end portion 341A as an end of first portion 341 faces a part corresponding to magnetic pole 321B of second developing roller 320.

Second portion 342 is a part which is bent from fixed end part 341B opposite to first end portion 341A of first portion 341, and obliquely extends from fixed end part 341B to the lower right in the drawing. Specifically, second portion 342 extends, from fixed end part 341B, to the side opposite to first developing roller 310, second developing roller 320 and collecting roller 330 relative to fixed end part 341B. That is, second end portion 342A as an end of second portion 342 is located at a position on the side opposite to first developing roller 310, second developing roller 320 and collecting roller 330 relative to fixed end part 341B.

To be more specific, second end portion 342A is located at a position where second end portion 342A does not intersect first line L1 which is an extension of a line passing through rotation center 333 of collecting roller 330 and magnetic pole 331C as the separation pole, or second line L2 which is an extension of a line passing through rotation center 323 of second developing roller 320 and magnetic pole 321A as the absorption pole. Since lines of magnetic force linearly extend from the end portions of magnetic poles 321A and 331C, magnetic force interference is caused between magnetic poles 321A and 331C, and second end portion 342A when the lines of magnetic force, and the magnetic force generated by second end portion 342A of restriction member 340 composed of a magnetic substance are connected with each other. When such magnetic force interference is caused, the poles of magnetic poles 321A and 331C are changed. When the poles of magnetic poles 321A and 331C are changed, conveyance failure due to absorption failure of developer at a part of magnetic pole 321A, separation failure of developer at a part of magnetic pole 331C and the like can disadvantageously occur.

However, in the present embodiment, second end portion 342A is not connected with the lines of magnetic force extending from the end portions of magnetic poles 321A and 331C, and therefore the problem of change of the poles of magnetic poles 321A and 331C is not caused. Therefore, the conveyance failure and the separation failure due to the change of the poles of magnetic poles 321A and 331C can be reduced.

Figure 4:
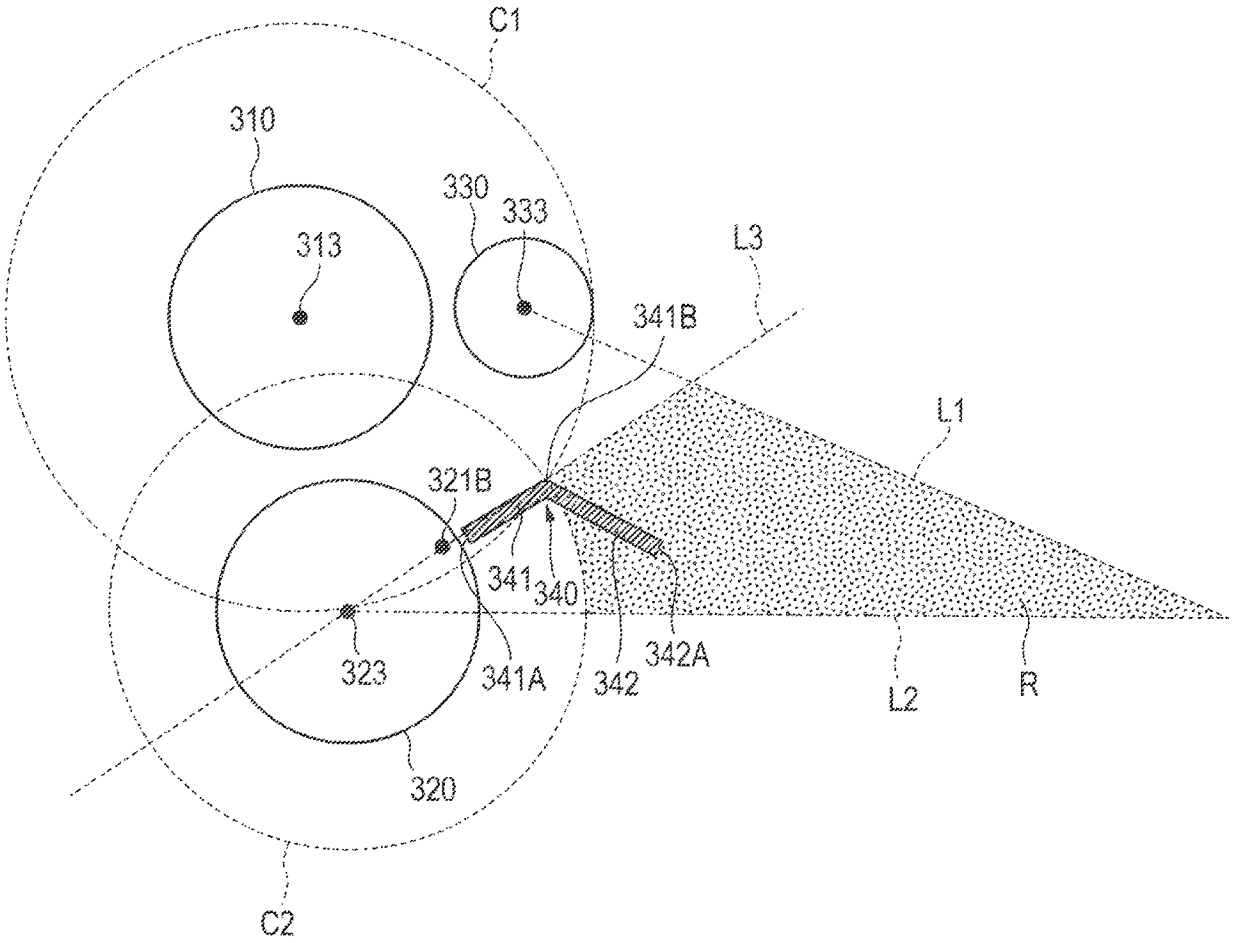
FIG. 4 illustrates a positional relationship of a second end portion of a restriction member relative to a first developing roller, a second developing roller and a collecting roller.

In addition, as illustrated in FIG. 4, second end portion 342A is located outside first circle C1 passing through fixed end part 341B around rotation center 313 of first developing roller 310, and, second circle C2 passing through fixed end part 341B around rotation center 323 of second developing roller 320. At such a location, second end portion 342A is sufficiently remote from the magnetic poles of first developing roller 310 and second developing roller 320, and thus intersection with any of lines of magnetic force of the magnetic poles can be reduced.

In addition, second end portion 342A is located at a position opposite to collecting roller 330 side with respect to third line L3 which is an extension of a line passing through rotation center 323 of second developing roller 320 and magnetic pole 321B as the restriction pole. At such a location, second end portion 342A is further remote from collecting roller 330, and the functions of collecting roller 330, namely, the collection function, the conveying function and the separation function can be improved.

In addition, in the present embodiment, second end portion 342A is located in region R defined by first line L1, second line L2, second circle C2, and third line L3. In this manner, the conveyance failure and the separation failure due to change of the magnetic poles can be reduced, and the functions of collecting roller 330 can be improved.

Figure 5:
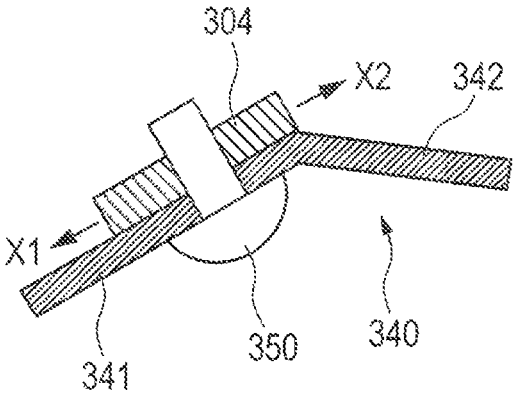
FIG. 5 illustrates a fixing part of the restriction member.

In addition, as illustrated in FIG. 5, first portion 341 of restriction member 340 is fixed by screw 350 composed of a non-magnetic substance to fixing part 304 in developer housing 301. Screw 350 is composed of a non-magnetic substance, and therefore, even when an end portion of screw 350 intersects a line of magnetic force generated by magnetic poles of first developing roller 310, second developing roller 320 and collecting roller 330, the magnetic pole is not changed. Therefore, restriction member 340 can be stably fixed.

In addition, restriction member 340 may be fixed such that restriction member 340 can move in the extending direction of first portion 341, that is, the directions of arrows X1 and X2. In this manner, the conveyance amount of the developer in second developing roller 320 can be adjusted.

Figure 6:
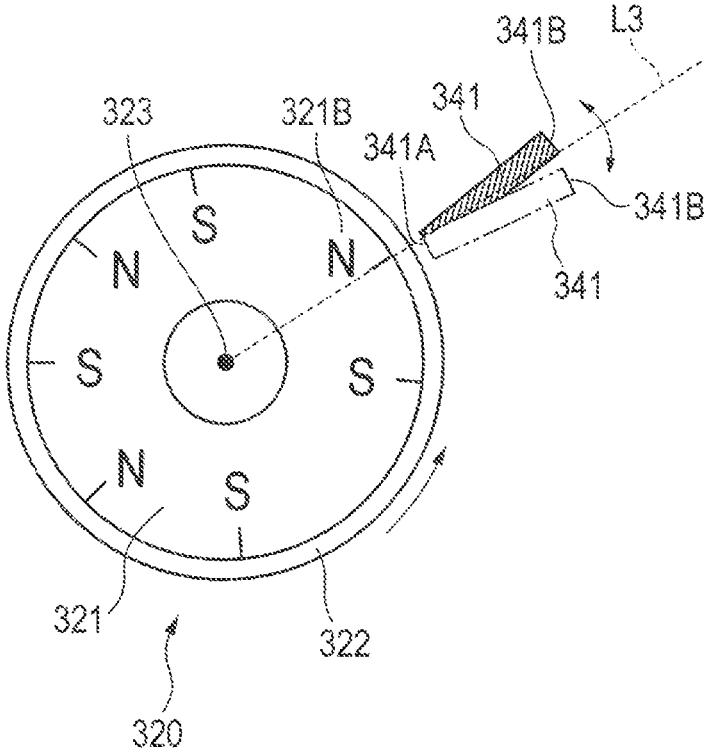
FIG. 6 illustrates a positional displacement of the restriction member.

As illustrated in FIG. 4, in addition to rotation center 323 of second developing roller 320 and magnetic pole 321B, first portion 341 of restriction member 340 is disposed on third line L3. However, since the fixation position of second developing roller 320 and/or the fixation position of restriction member 340 can be shifted in some situation, the position of restriction member 340 can be shifted with respect to third line L3. Therefore, as illustrated in FIG. 6, for example, fixed end part 341B of restriction member 340 may be shifted at a predetermined angle (for example, about ±10°) with respect to third line L3 in the present embodiment. It is to be noted that second portion 342 of restriction member 340 is omitted in FIG. 6.

According to the present embodiment having the above-mentioned configuration, second end portion 342A of restriction member 340 is located on a side opposite to first developing roller 310, second developing roller 320 and collecting roller 330 with respect to fixed end part 341B, and thus second end portion 342A is remote from the magnetic poles of first developing roller 310, second developing roller 320 and collecting roller 330. In this manner, the lines of magnetic force extending from the magnetic poles of first developing roller 310, second developing roller 320 and collecting roller 330, and second end portion 342A do not easily intersect. Accordingly, by using a magnetic substance such as metal for restriction member 340, the conveyance failure and the separation failure due to change of the magnetic pole can be suppressed while maintaining the strength of restriction member 340.

In the present embodiment, magnetic pole 331B as the conveyance pole is disposed on the lower side relative to rotation center 333 of collecting roller 330, and thus magnetic pole 331B is further close to restriction member 340. For example, in the case of a restriction member having a linear shape, intersection of the line of magnetic force extending from magnetic pole 331B and an end portion of the fixing portion can be suppressed by reducing the length of the fixing portion of the restriction member. However, when the length of the fixing portion of the restriction member is reduced, the strength of the restriction member is insufficient, and the conveyance amount of the developer in the developing roller cannot be restricted, and in turn, conveyance failure in the developing roller can be caused.

In contrast, in the present embodiment, second end portion 342A of restriction member 340 is disposed at a position remote from collecting roller 330, and thus the line of magnetic force extending from magnetic pole 331B and second end portion 342A do not easily intersect. Therefore, the length of the fixing portion of restriction member 340 can be increased, and the fixing portion of restriction member 340 can be firmly fixed. As a result, the strength of restriction member 340 can be maintained, and in turn, the conveyance failure in second developing roller 320 can be suppressed.

In addition, since second end portion 342A is located at a position where second end portion 342A does no intersect first line L1 or second line L2, second end portion 342A does not intersect the line of magnetic force extending magnetic pole 331C as the separation pole or magnetic pole 321A as the absorption pole. Accordingly, the conveyance failure and the separation failure due to change of the poles of magnetic poles 321A and 331C can be suppressed.

In addition, since second end portion 342A is located at a position separated from first circle C1 and second circle C2, second end portion 342A is sufficiently remote from the magnetic poles of first developing roller 310 and second developing roller 320. Accordingly, intersection of second end portion 342A with any of the lines of magnetic force of the magnetic poles of first developing roller 310 and second developing roller 320 can be suppressed.

In addition, since second end portion 342A is located on a side opposite to collecting roller 330 with respect to third line L3, second end portion 342A is further remote from second end portion 342A of collecting roller 330. Accordingly, the magnetic pole of collecting roller 330 is not changed, and thus the functions of collecting roller 330 can be improved.

In addition, second end portion 342A is located in region R defined by first line L1, second line L2, second circle C2, and third line L3, the conveyance failure and the separation failure due to change of the magnetic poles can be suppressed, and the functions of collecting roller 330 can be improved.

Figure 7:
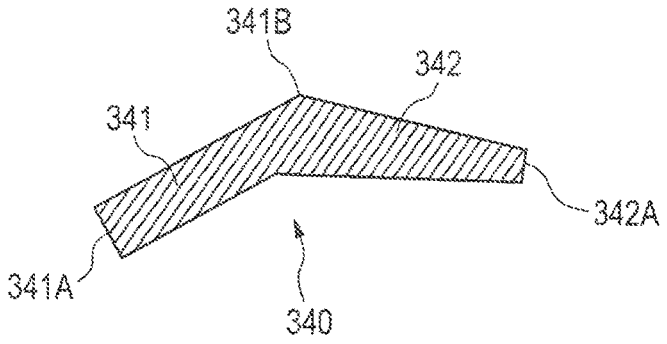
FIG. 7 illustrates a restriction member according to modification 1.

While restriction member 340 is a bent plate-shaped member and, for example, the thickness of second portion 342 is uniform in the present embodiment, the present invention is not limited to this. For example, as illustrated in FIG. 7, the thickness of second portion 342 may be reduced from second end portion 342A toward fixed end part 341B. With this configuration, the end surface of second end portion 342A can be reduced, and connection with the line of magnetic force can be suppressed.

Figure 8:
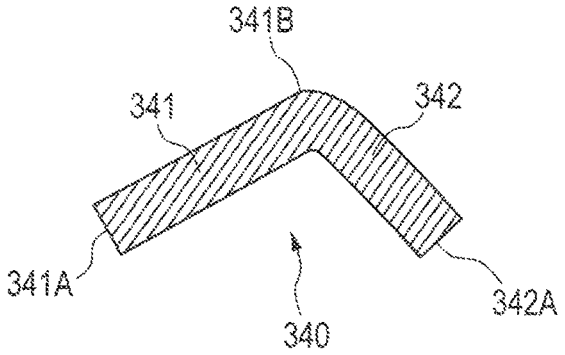
FIG. 8 illustrates a restriction member according to modification 2.

In addition, while the bent portion of restriction member 340 is angular in the present embodiment, the present invention is not limited to this, and, for example, as illustrated in FIG. 8, the bent portion of restriction member 340 may have an R-shape.

Figure 9:
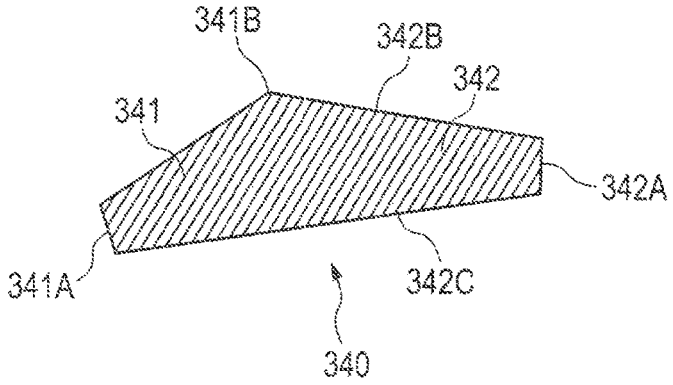
FIG. 9 illustrates a restriction member according to modification 3.

In addition, while restriction member 340 is a plate-shaped member in the present embodiment, the present invention is not limited to this, and restriction member 340 may not be a plate-shaped member. For example, it is also possible to adopt a configuration in which second portion 342 includes first surface 342B extending to the side opposite to collecting roller 330 and first developing roller 310 from fixed end part 341B of first portion 341 with respect to fixed end part 341B, and second surface 342C that linearly connects first end portion 341A and second end portion 342A as illustrated in FIG. 9.

In addition, while a monochrome image forming apparatus is exemplified in the present embodiment, a color image forming apparatus may also be adopted.

The embodiments disclosed herein are merely exemplifications and should not be considered as limitative. While the invention made by the present inventor has been specifically described based on the preferred embodiments, it is not intended to limit the present invention to the above-mentioned preferred embodiments but the present invention may be further modified within the scope and spirit of the invention defined by the appended claims.

The present invention is applicable to an image forming system composed of a plurality of units including an image forming apparatus. The units include, for example, a post-processing apparatus, an external apparatus such as a control apparatus connected with a network, and the like.

What is claimed is:

1. A developing device comprising:

a developer housing configured to house developer;

a first developing roller facing an image bearing member at a first development nip, the first developing roller being configured to convey the developer toward the first development nip;

a second developing roller facing the image bearing member at a second development nip on a downstream side relative to the first developing roller in a rotational direction of the image bearing member, and facing the first developing roller, the second developing roller being configured to convey the developer toward the image bearing member;

a restriction member including a first end portion and a second end portion located on a side opposite to the first end portion, the first end portion being configured to restrict an amount of the developer on the second developing roller, and the second end portion being configured to generate a magnetic force; and a collecting roller facing the first developing roller in the developer housing, the collecting roller being configured to collect the developer on the first developing roller with a magnetic force at a position on a downstream side relative to the first developing roller in a rotational direction of the first development nip, wherein the second end portion is located at a position where magnetic force interference with a magnetic force generated by the second developing roller and the collecting roller is not caused.

2. The developing device according to claim 1, wherein:

the collecting roller includes a separation pole configured to generate a magnetic field for separating the developer collected from the first developing roller;

the second developing roller includes an absorption pole configured to generate a magnetic field for absorbing the developer in the developer housing; and the second end portion does not intersect a first line or a second line, the first line being an extension of a line passing through a rotation center of the collecting roller and the separation pole, the second line being an extension of a line passing through a rotation center of the second developing roller and the absorption pole.

3. The developing device according to claim 2, wherein the second end portion is located outside a first circle around a rotation center of the first developing roller, and a second circle around the rotation center of the second developing roller, the first circle being a circle which passes through a fixed part of the restriction member in the developer housing, the second circle being a circle which passes through the fixed part of the restriction member in the developer housing.

4. The developing device according to claim 2, wherein the second end portion is located on a side opposite to the collecting roller with respect to a third line which is an extension of a line passing through the rotation center of the second developing roller and a restriction pole of the second developing roller, the restriction pole being a pole which faces the first end portion.

5. The developing device according to claim 1, wherein the collecting roller includes a conveyance pole which is located at a position on a lower side relative to the rotation center of the collecting roller, the conveyance pole being configured to generate a magnetic field for conveying the developer collected from the first developing roller.

6. The developing device according to claim 5, wherein the restriction member is located on the conveyance pole side relative to the rotation center of the collecting roller.

7. The developing device according to claim 1, wherein:

the restriction member is a plate-shaped member fixed in the developer housing; and the second end portion is an end portion of a part bent from a part of the plate-shaped member bent in the developer housing.

8. The developing device according to claim 1, wherein:

a rotational direction of the first developing roller is opposite to a rotation direction of the image bearing member at the first development nip; and a rotational direction of the second developing roller is identical to the rotation direction of the image bearing member at the second development nip.

9. An image forming apparatus comprising:

a developer housing configured to house developer;

a first developing roller facing an image bearing member at a first development nip, the first developing roller being configured to convey the developer toward the first development nip;

a second developing roller facing the image bearing member at a second development nip on a downstream side relative to the first developing roller in a rotational direction of the image bearing member, and facing the first developing roller, the second developing roller being configured to convey the developer toward the image bearing member;

a restriction member including a first end portion and a second end portion located on a side opposite to the first end portion, the first end portion being configured to restrict an amount of the developer on the second developing roller, and the second end portion being configured to generate a magnetic force; and a collecting roller facing the first developing roller in the developer housing, the collecting roller being configured to collect the developer on the first developing roller with a magnetic force at a position on a downstream side relative to the first developing roller in a rotational direction of the first development nip, wherein the second end portion is located at a position where magnetic force interference with a magnetic force generated by the second developing roller and the collecting roller is not caused.

10. The image forming apparatus according to claim 9, wherein:

the collecting roller includes a separation pole configured to generate a magnetic field for separating the developer collected from the first developing roller;

the second developing roller includes an absorption pole configured to generate a magnetic field for absorbing the developer in the developer housing; and the second end portion does not intersect a first line or a second line, the first line being an extension of a line passing through a rotation center of the collecting roller and the separation pole, the second line being an extension of a line passing through a rotation center of the second developing roller and the absorption pole.

11. The image forming apparatus according to claim 10, wherein the second end portion is located outside a first circle around a rotation center of the first developing roller, and a second circle around the rotation center of the second developing roller, the first circle being a circle which passes through a fixed part of the restriction member in the developer housing, the second circle being a circle which passes through the fixed part of the restriction member in the developer housing.

12. The image forming apparatus according to claim 10, wherein the second end portion is located on a side opposite to the collecting roller with respect to a third line which is an extension of a line passing through the rotation center of the second developing roller and a restriction pole of the second developing roller, the restriction pole being a pole which faces the first end portion.

13. The image forming apparatus according to claim 9, wherein the collecting roller includes a conveyance pole which is located at a position on a lower side relative to the rotation center of the collecting roller, the conveyance pole being configured to generate a magnetic field for conveying the developer collected from the first developing roller.

14. The image forming apparatus according to claim 13, wherein the restriction member is located on the conveyance pole side relative to the rotation center of the collecting roller.

15. The image forming apparatus according to claim 9, wherein:

the restriction member is a plate-shaped member fixed in the developer housing; and the second end portion is an end portion of a part bent from a part of the plate-shaped member bent in the developer housing.

16. The image forming apparatus according to claim 9, wherein:

a rotational direction of the first developing roller is opposite to a rotation direction of the image bearing member at the first development nip; and a rotational direction of the second developing roller is identical to the rotation direction of the image bearing member at the second development nip.

* * * * *